US005720191A

United States Patent [19]

Tsung-Chuan et al.

[11] Patent Number: 5,720,191

[45] Date of Patent: Feb. 24, 1998

[54] PADLOCK

[76] Inventors: Huang Tsung-Chuan; Huang Tang-Cheng, both of P.O. Box 28-24, Kaohsiung, Taiwan

[21] Appl. No.: 800,570

[22] Filed: Feb. 18, 1997

[51] Int. Cl.[6] ..... E05B 67/24

[52] U.S. Cl. ..... 70/38 A; 70/39; 70/43; 70/360; 70/491

[58] Field of Search ..... 70/38 R, 38 A, 70/38 B, 38 C, 39, 42, 43, 360, 361, 491

[56] References Cited

U.S. PATENT DOCUMENTS 5,133,203 7/1992 Huang ..... 70/491 X
5,195,340 3/1993 Huang ..... 70/491 X
5,253,496 10/1993 Wang ..... 70/43 X
5,410,895 5/1995 Hsu et al. ..... 70/43 X
5,490,402 2/1996 Shieh ..... 70/43 X
5,511,400 4/1996 Ma ..... 70/360 X

*Primary Examiner*—Lloyd A. Gall
*Attorney, Agent, or Firm*—Bacon & Thomas

[57] ABSTRACT

A padlock includes a lock unit housed in one end of a tubular housing, and a shackle provided with a notch in one or both feet for the lock unit to fit and keep immovable the shackle feet in the housing in locking. In addition, locking dimensions of the lock unit with the shackle is made substantially larger than conventional ones to prevent the padlock from being illegally broken.

4 Claims, 9 Drawing Sheets

PADLOCK

BACKGROUND OF THE INVENTION

This invention concerns a padlock, particularly having a larger dimension of one or two locking points of a lock unit with a shackle so as to reinforce protective force of the padlock against illegal break.

A known conventional padlock shown in FIG. 1 includes a tubular housing 11, a lock unit 12 housed in one end portion of the housing 11, and a U-shaped shackle 14. Then a bolt 13 extending from the lock unit 12 fits in a notch 15 in one foot of the shackle 14 in locking. In locking, a key is not needed, very convenient to use.

However, the bolt 13 is commonly small, and a locking dimension of the bolt 13 with the notch 15 of the shackle 14 may be also small, not large enough to resist illegal break.

SUMMARY OF THE INVENTION

This invention has been devised to offer a padlock having a substantially large dimension for a lock unit to engage a shackle to prevent it from being broken by illegal measures.

A feature of the invention is a lock unit consisting of a sleeve, a pin base, a base cap, a bolt, a spring urging the bolt and a bolt holder. The sleeve has a spring fitting around its intermediate portion, a slot extending from an inner end to the intermediate portion. The pin base has a front rod portion and a rear disc portion, contained in the sleeve, and combined with the base cap, with plural pins and plural springs urging relative pins provided between the pin base and the base cap. The base cap has a slot extending from a front end to near a rear end in corresponding to the slot of the sleeve. The lock unit consisting of the sleeve, the pin base and the base cap is inserted through an open end of the housing and deposited in the open end portion and kept in place by means of a pin. The bolt holder contains the spring and the bolt urged by the spring and fitted in a hole of the housing, with the bolt having its lower end able to engage with a sloped recess in the rod portion of the pin base. The bolt engages the sloped recess to keep the lock unit immovable to lock the shackle immovable by means of the inner end of the sleeve fitting in the notch of the shackle in case the lock unit is pushed in the housing from an unlocked position to a locked position. In unlocking, a key is to be used to rotate the pin base to disengage the bolt from the recess so that the lock unit may be moved back to the unlocked position by elasticity of the spring fitting around the sleeve.

BRIEF DESCRIPTION OF DRAWINGS

This invention will be better understood by referring to the accompanying drawings, wherein.

DESCRIPTION OF THE PREFERRED EMBODIMENTS

Figure 1:
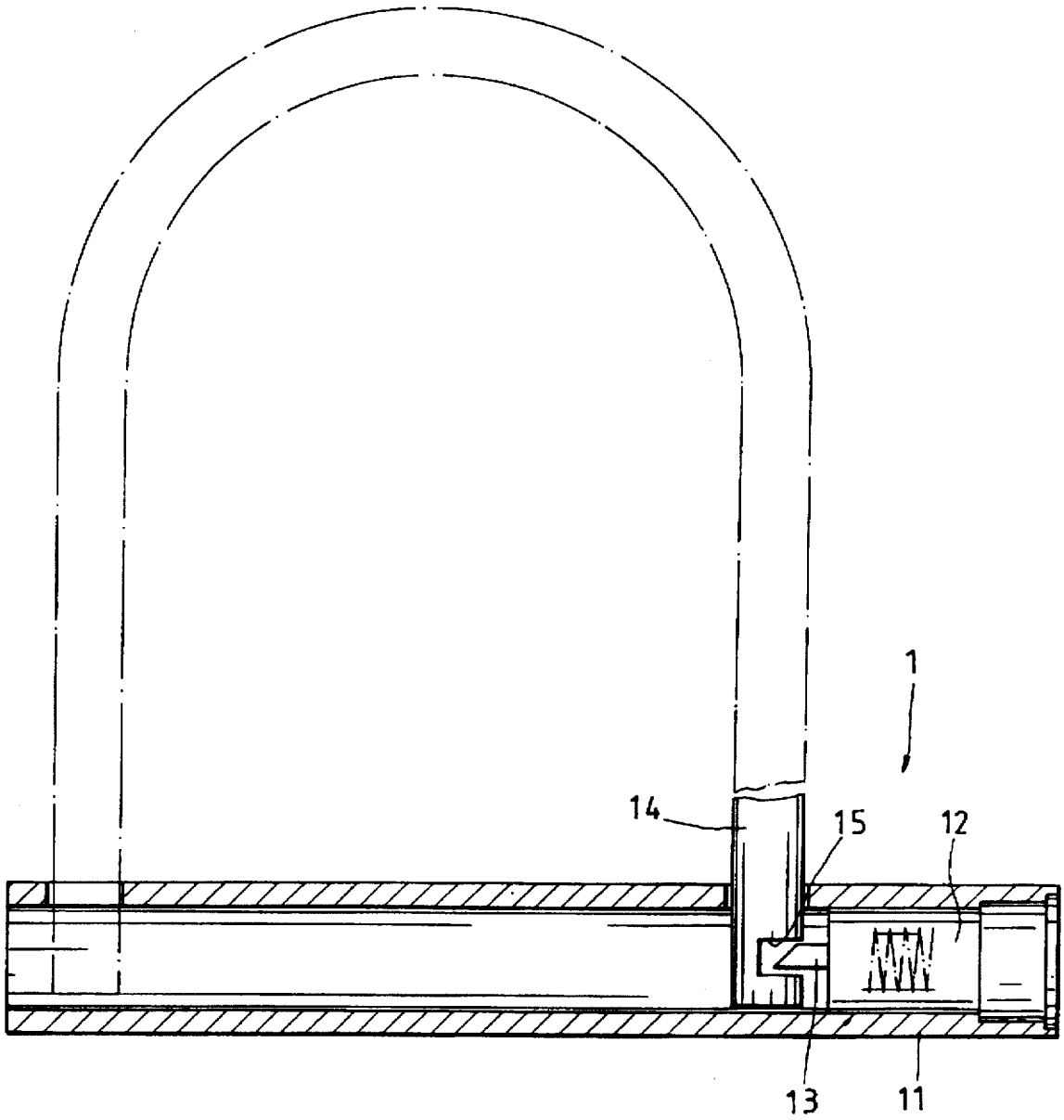
FIG.1 PRIOR ART
FIG. 1 is a side view of a known conventional padlock.
Figure 2:
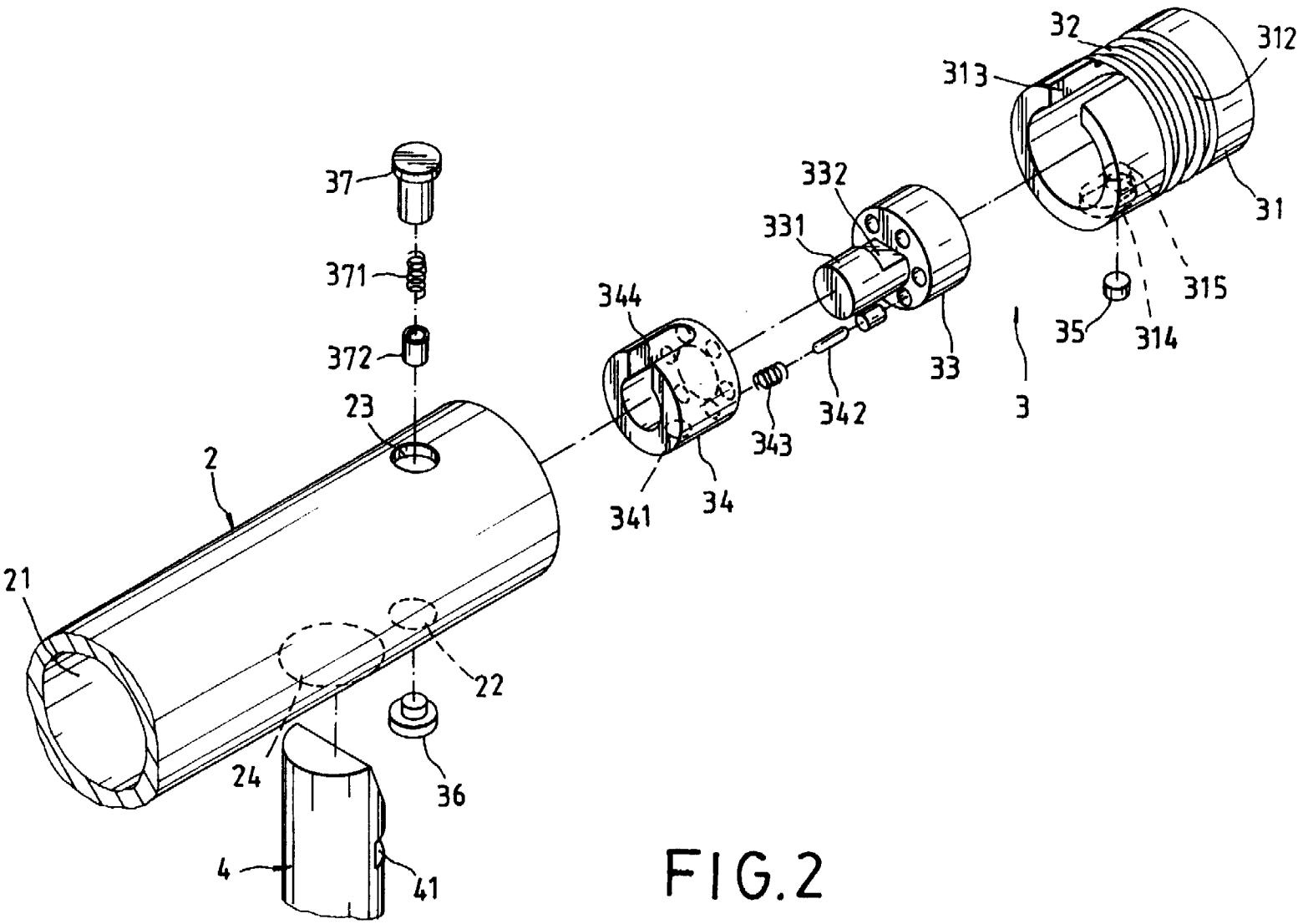
FIG. 2 is an exploded perspective view of a first preferred embodiment of a padlock in the present invention.
Figure 3:
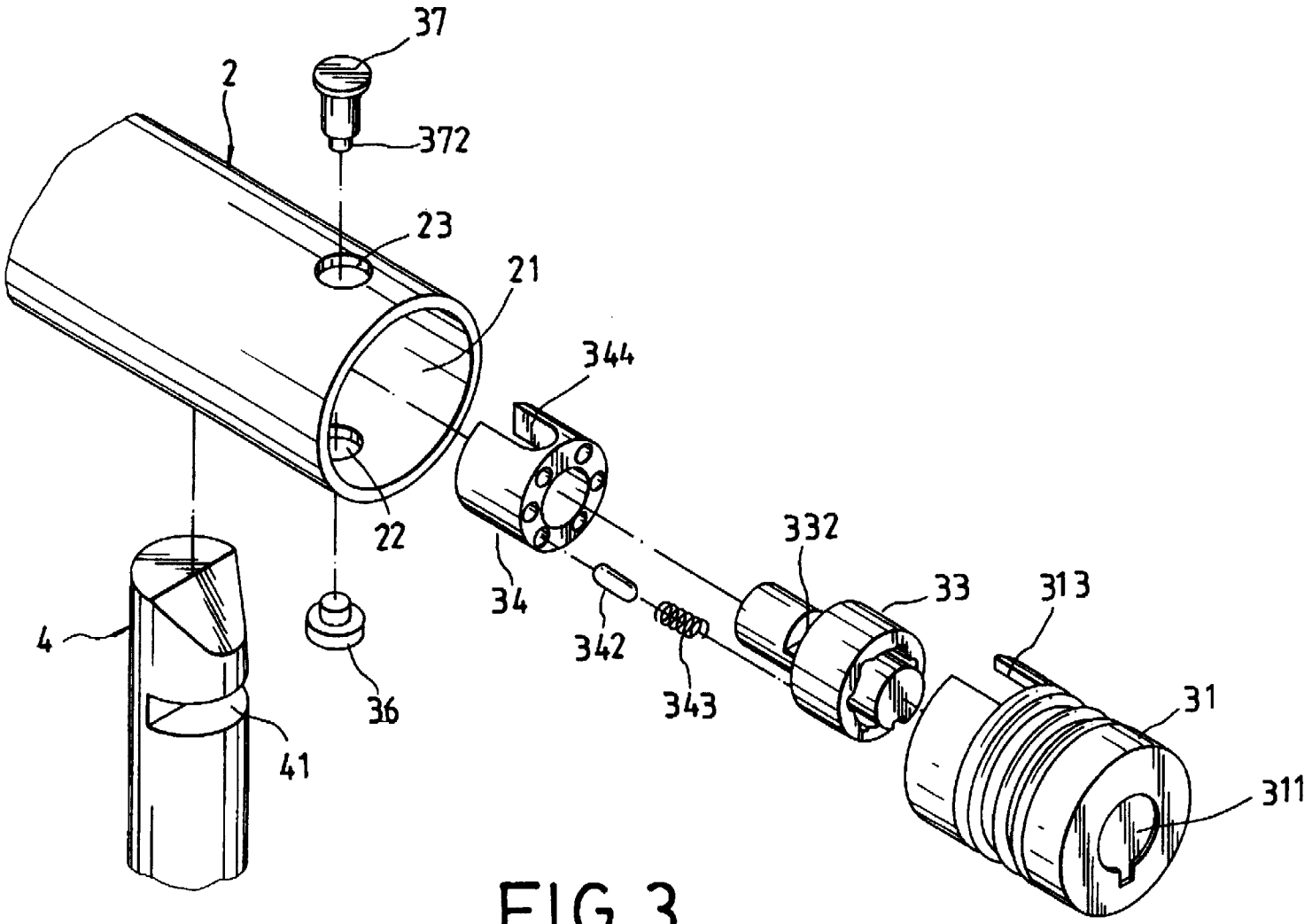
FIG. 3 is an exploded perspective view of the first preferred embodiment of a padlock in the present invention, viewed from a different direction from that in FIG. 2.

A first preferred embodiment of a padlock in the present invention, as shown in FIGS. 2 and 3, includes a housing 2, a lock unit 3 and a shackle 4 as main components combined together.

The housing 2 is tubular, having an open end 21 for the locking unit 3 to pass through in the housing 2 and deposited therein, two opposite holes 22, 23 in the wall of the open end portion, and two shackle holes 24 spaced apart for two feet of the shackle 4 to insert in.

The lock unit 3 consists of a tubular sleeve 31, a spring 32, a pin base 33, a base cap 34, a pin 36, a bolt holder 37, a spring 371, and a bolt 372 combined together.

The tubular sleeve 31 has a central key hole 311, a groove 312 in an intermediate portion for the spring 32 to fit around, a longitudinal slot 313 extending from an inner end to the intermediate portion, a groove 314 and a pin hole 315 in an opposite side from the slot 313.

The pin base 33 has a front rod portion 331 and rear disc portion with a larger diameter than the front rod portion 331, a key hole in the rear disc portion, and an outer end surface being flush with the outer end surface of the sleeve 31, fitted movably in the sleeve 31 with the rod portion 331 fitted in a center hole in the base cap 34. Then a pin 35 is inserted through the pin hole 315 of the sleeve 31 and a hole 341 of the base cap 34 so that the pin base 33 and the base cap 34 may be combined and secured in the sleeve 31.

Between the pin base 33 and the base cap 34 are provided many pins 342 and many springs 343 urging the relative pins 342. Further, the front rod portion 331 of the pin base 33 has a sloped recess 332, and the base cap 34 has a slot 344 to correspond to the slot 313 of the sleeve 31.

The lock unit 3 consisting of the sleeve 31, the spring 32, the pin base 33 and the base cap 34 is inserted in through the open end 21 of the housing 2, and secured firmly in the housing 2 by means of the pin 36 fitting in the pin hole 22 of the housing 2 and in the groove 314 of the sleeve 31.

The bolt holder 37 has an inner cavity to contain the bolt 372 and the spring 371 urging down the bolt 372, inserted through the hole 23 of the housing 2 and in the slots 313, 344 of the sleeve 31 and the pin base cap 34. The bolt 372 properly engages with the sloped recess 332 of the pin base 33, with its lower end urging the upper surface of the recess 332 in case the padlock is locked in a locked position, preventing directly the pin base 33 and indirectly the sleeve 31 from moving, in other words, the padlock is locked.

The shackle 4 has a notch 41 in one of the two feet for an inner end wall of the sleeve 31 to fit therein in case the padlock is locked in the locked position.

Figure 4:
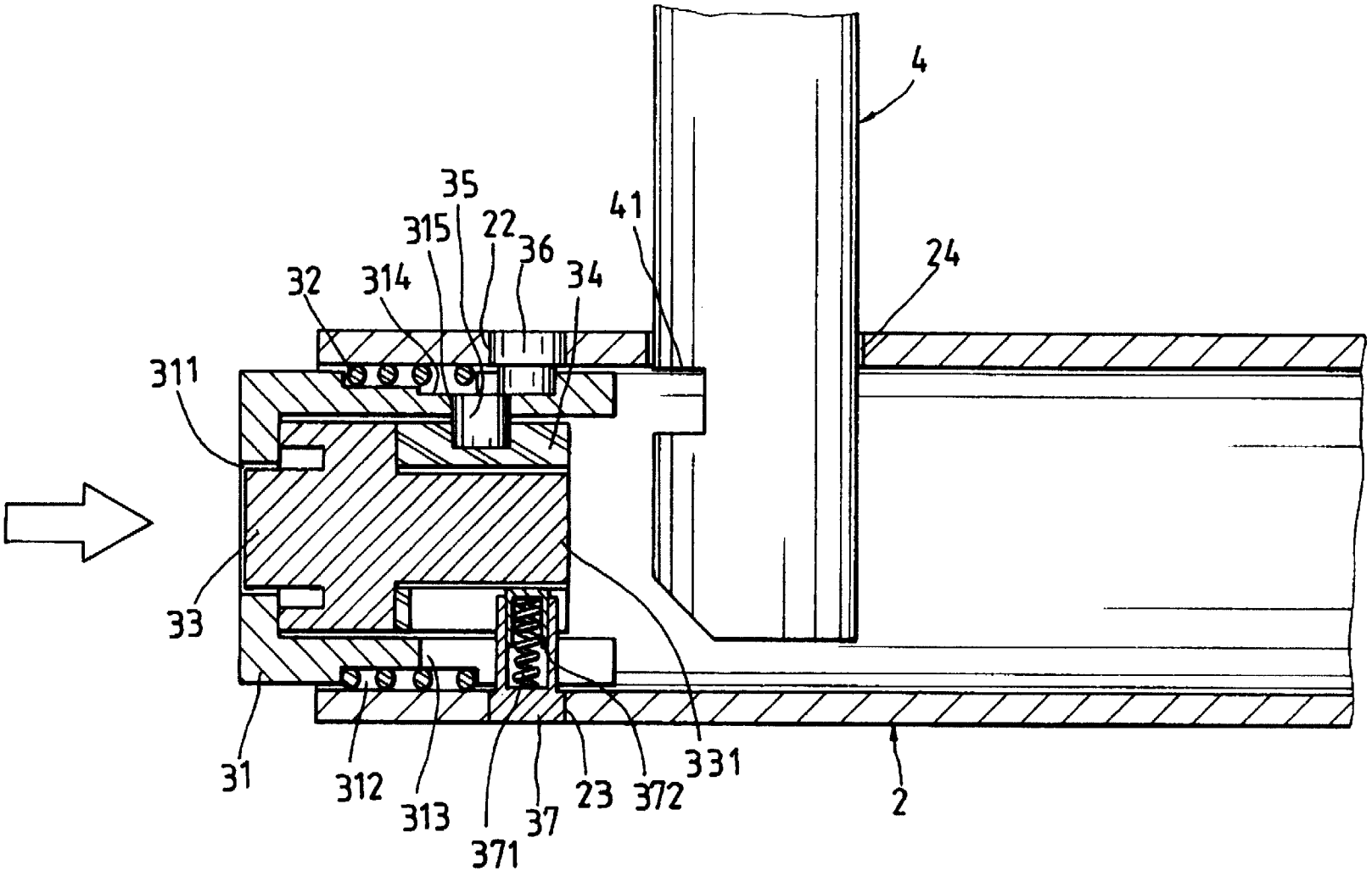
FIG. 4 is a cross-sectional view of the first preferred embodiment of a padlock in the present invention, showing it in an unlocked position.
Figure 5:
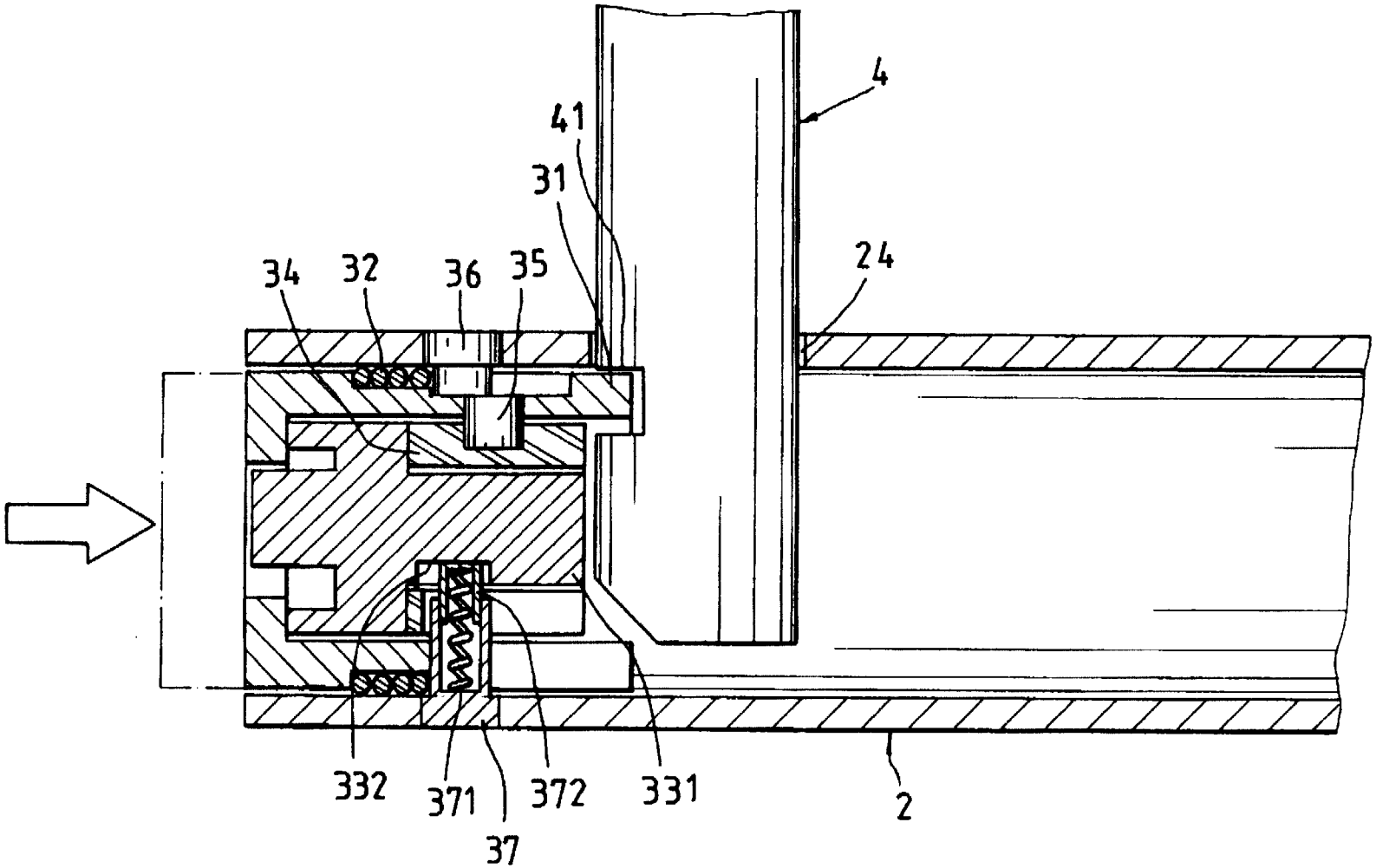
FIG. 5 is a cross-sectional view of the first preferred embodiment of a padlock in the present invention, showing it in a locked position.

After this padlock is assembled together as described above, it can be applied to lock wheels of a motorcycle, etc. In locking, it is convenient to use without a key by pushing the shackle 4 vertically in the shackle holes 24 of the housing 2 and the lock unit 3 is pushed in the housing 2 from an unlocked position shown in FIG. 4 to a locked position shown in FIG. 5. For example, the shackle 4 is inserted in the holes 24 of the housing 2, and then the lock unit 3 is pushed in the housing 2, letting the bolt 372 engage the sloped recess 332 of the pin base 33. At the same time, the inner end wall of the sleeve 31 also engages the notch 41 in one foot of the shackle 4 to lock the same immovable. In FIGS. 4 and 5, another advantage of this lock can be understood. It is that the sleeve 31 not only engages the shackle 4, but also has a large dimension for engaging the shackle 4. In addition, the sleeve 31 is not liable to deform by means of exterior force, indirectly protected by the housing 2 as well. Therefore, the lock unit 3 has more strength than those in conventional padlocks, unbreakable from outside by hitting the housing 2.

Unlocking this padlock is also very simple. Referring to FIG. 3, a key is inserted in the key hole 311 and rotate the pin base 33 for a certain preset angle, forcing the recess 332 disengage from the bolt 372. Then the spring 32 compressed in the locked position can elastically force the sleeve 31 together with the pin base 33 and the base cap 34 move outward to the unlocked position, freeing the shackle 4, which is then able to be pulled out of the housing 2.

Figure 6:
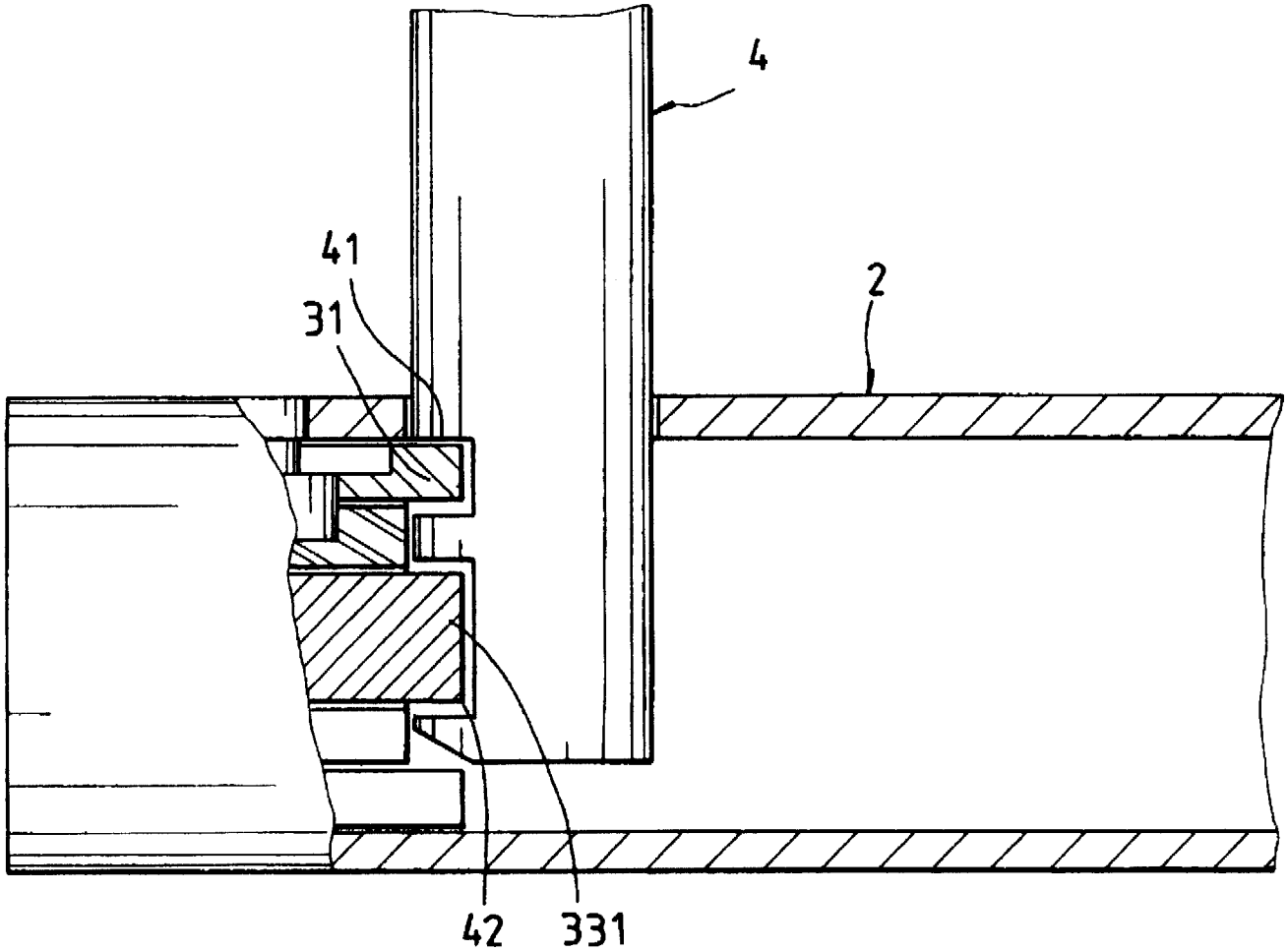
FIG. 6 is a cross-sectional view of a second preferred embodiment of a padlock in the present invention, showing it in a locked position.

A second preferred embodiment of a padlock in the present invention is shown in FIG. 6, having the same structure as the first preferred embodiment except a front rod portion 331 of the pin base 33 made to be a little longer than that of the first preferred embodiment, and another notch 42 additionally provided in the same foot having the notch 41 of the shackle 4 for the end of the front rod portion 331 to fit therein. Then if the lock unit 3 is pushed in the locked position, the shackle 4 doubly engages with the locking unit 3 by means of the sleeve 31 and the rod portion 331, reinforcing locking strength.

Figure 7:
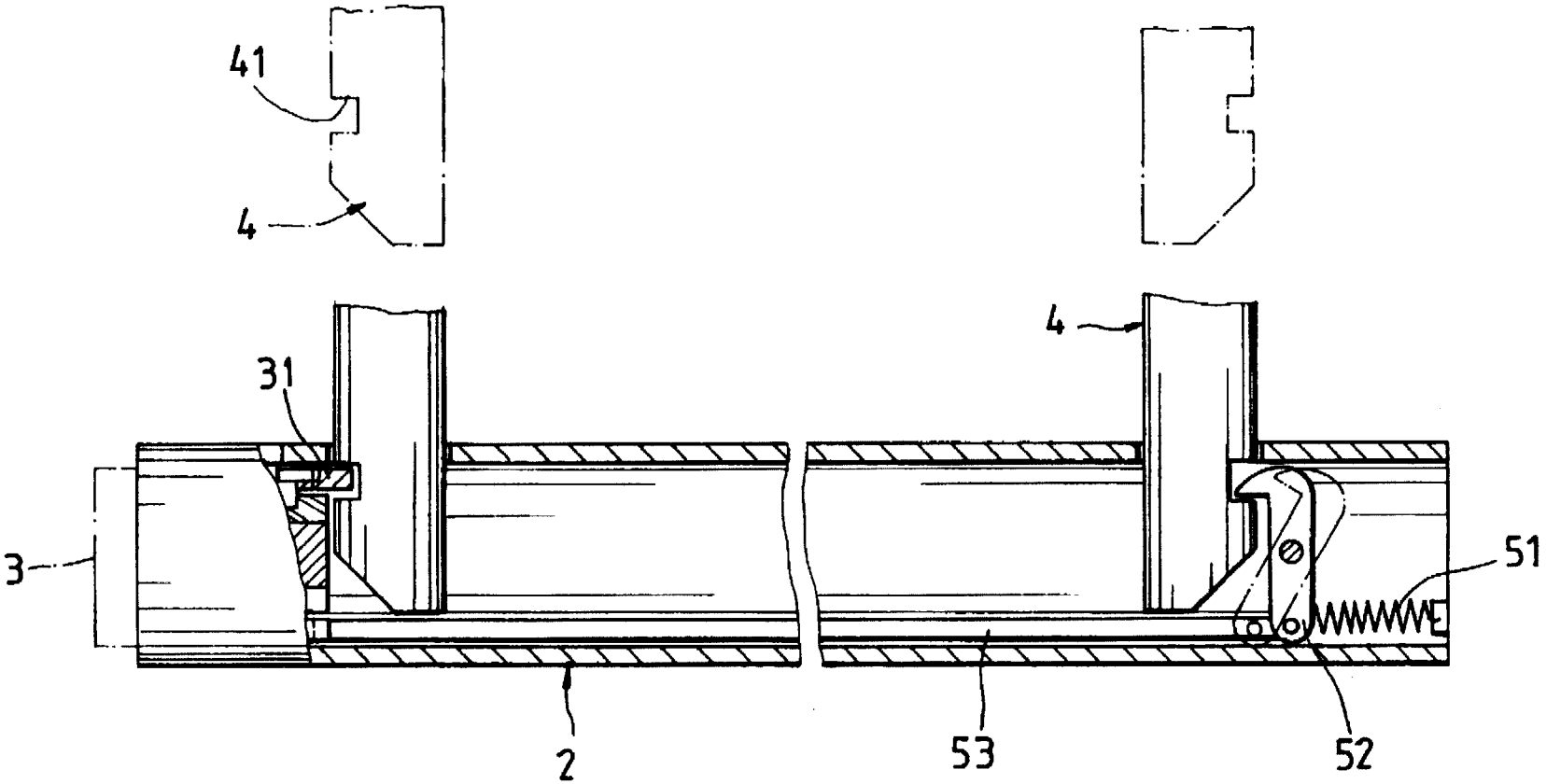
FIG. 7 is a cross-sectional view of a third preferred embodiment of a padlock in the present invention, showing it in an unlocked position and in a locked position.

A third preferred embodiment of the present invention is shown in FIG. 7, having the same structure as that of the first embodiment, except an auxiliary locking means additionally provided in the housing 2 to lock the other foot of the shackle 4 at the same time together with the lock unit 3 locking one foot of the shackle 4 in the first embodiment. The auxiliary locking means includes a spring 51, a hook rod 52 and a long rod combined together. The hook rod 52 is pivotally fixed with the other end portion of the housing 2 at an intermediate portion with a pivotal pin and a spring 51 is provided between the lower end of the hooked rod 52 and the other closed end of the housing 2 so as to urge the lower end of the hooked rod 52. The long rod 53 has one end connected with the lower end of the hooked rod 52 and the other end being in contact with the lock unit 3 in the housing 2. Then the push rod 53 can move inward at the same time with the lock unit 3 pushed in the housing 2 in locking, and the hook rod 52 is pivotally moved to have its hook end move to the left to hook the other notch provided in the other foot of the shackle 4. Then the shackle 4 is doubly locked at the two feet by the sleeve 31 and the hook rod 52.

Figure 8:
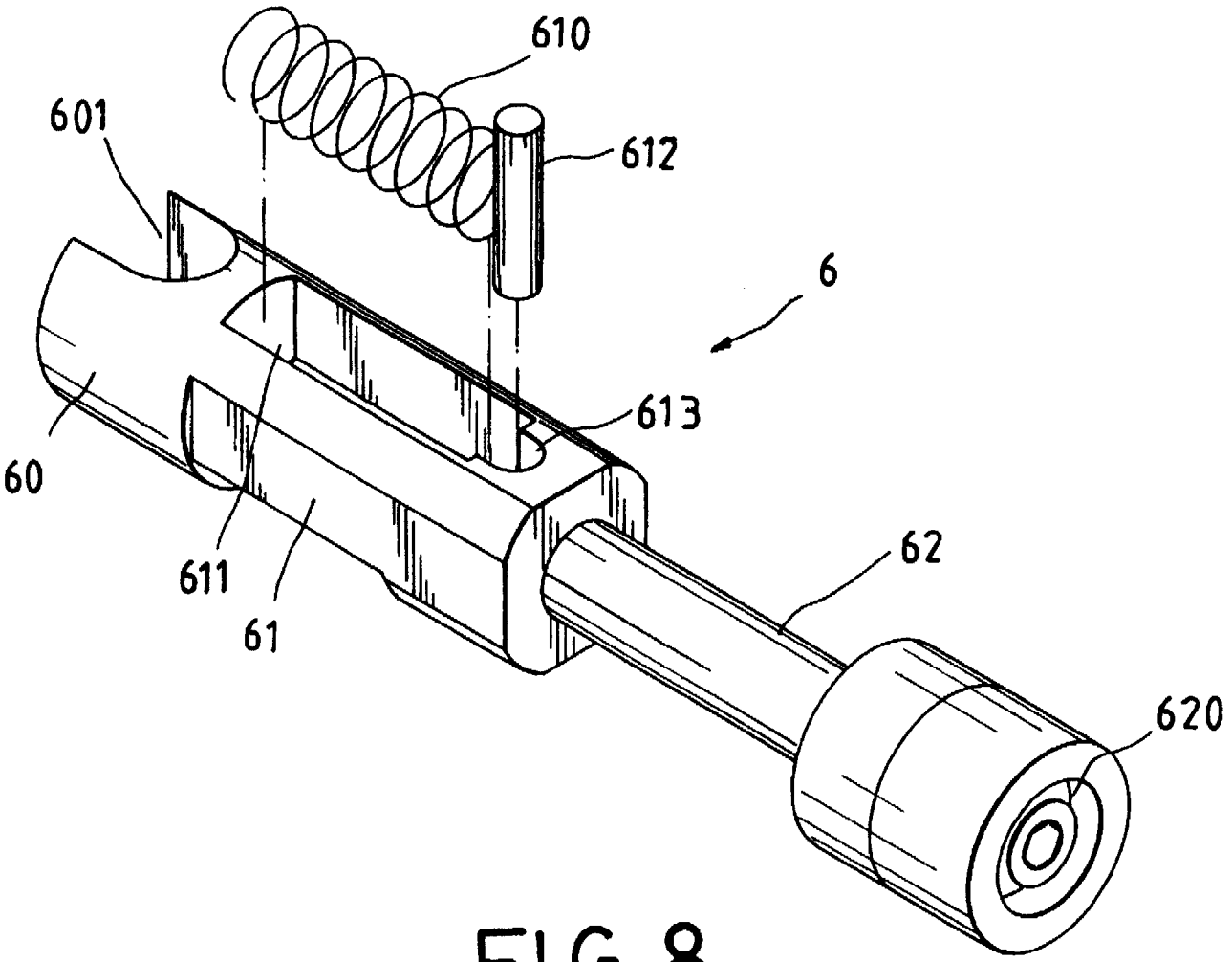
FIG. 8 is a perspective view of an auxiliary locking means in a fourth preferred embodiment of a padlock in the present invention; and, FIG. 9 is a cross-sectional view of the fourth preferred embodiment of a padlock in the present invention, showing it in a locked position.
Figure 9:
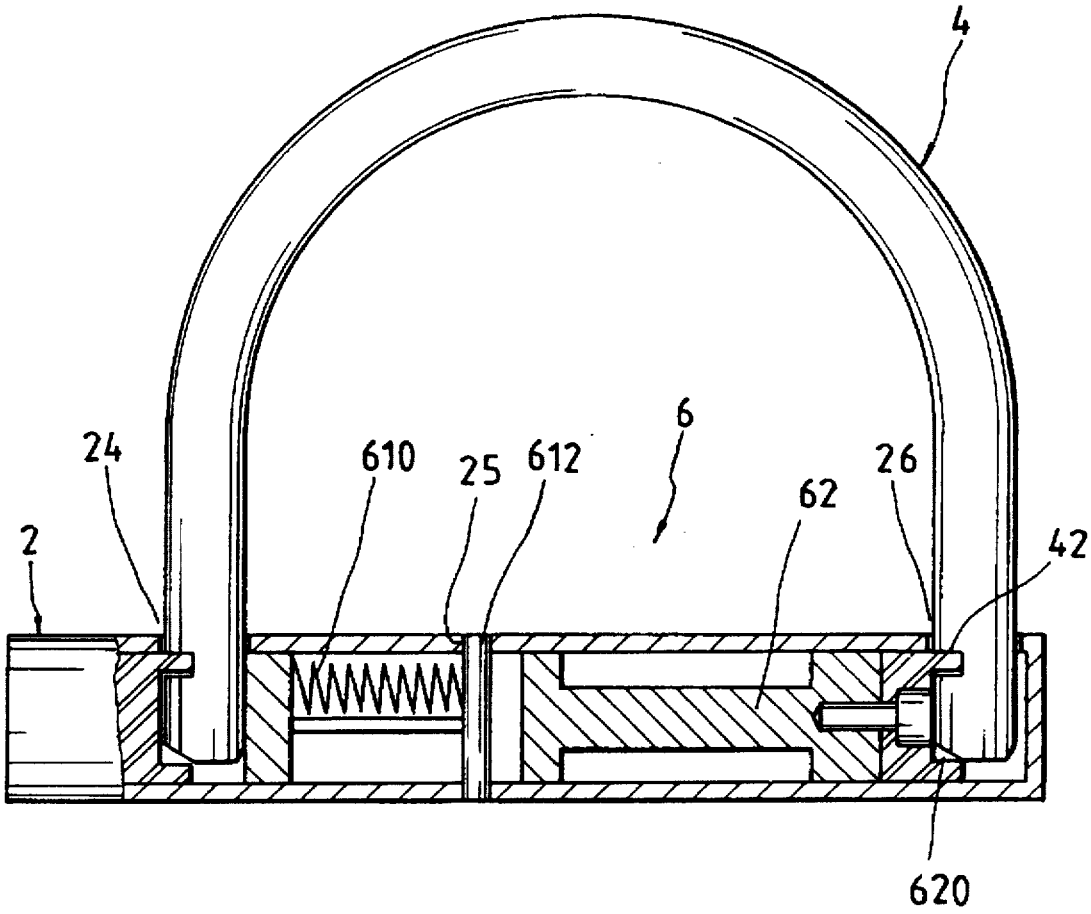

A fourth preferred embodiment of the invention is shown in FIGS. 8 and 9, has the same structure as the first embodiment except an auxiliary locking means 6 additionally provided for doubly locking the two feet of the shackle 4 at the same time, as the third preferred embodiment of the invention does. Then the shackle 4 also has two notches 41, 42 in the two feet, and the housing 2 additionally has two opposite position holes 25 in an intermediate portion for depositing a position pin 612 therein. The housing 2 further has a shackle hole 26 near the closed end for the other foot of the shackle 4 to fit therein.

The auxiliary locking means 6 has a left portion 60, which has its left end in contact with the inner end surface of the sleeve 31 and a shackle hole 601 for one foot of the shackle 4 to pass through, in corresponding to the shackle hole 24 of the housing 2. The auxiliary locking means 6 further has a control portion 61 formed behind the front left portion 60, and the control portion 61 has an cavity 611 in the center portion for depositing a spring 610 therein, and the cavity 611 has a small position hole 613 formed in a right end in corresponding to the position holes 25 for a position pin 612 to fit therein and in the holes 23. The position pin 612 in the position holes 25 of the housing 2 and in the position hole 613 of the control portion keeps securely the auxiliary locking means 6 in place in the housing 2. The auxiliary locking means further has a right hook portion 62 formed behind the control portion 61, and the hook portion 62 has an annular end 620 able to engage with the notch 42 of the shackle 4 in case the padlock is in the locked position.

In locking the padlock of the fourth preferred embodiment, the lock unit 3 is pushed in the housing 2 and at the same time the auxiliary locking means 6 is also moved inward to compress the spring 610, with the position pin 612 functioning as an immovable post. Then the annular end 620 engages the notch 42 of the shackle 4, and thus the padlock is locked at two locations as the third embodiment does.

In unlocking the padlock of the fourth preferred embodiment, the auxiliary locking means moves back to the unlocked position at the same time by the lock unit 3 unlocked to the unlocked position by a key, allowing the spring 610 recover elasticity to push back the whole auxiliary locking means 6 to the unlocked position, with the annular end 620 no longer engaging the notch 42 of the shackle 4. The right hook portion 62 can be made integral or into a front portion and a rear portion connected together.

The various locking structure in the padlocks in the present invention can be utilized in other locks such as cable locks, automobile steering locks, etc.

While the preferred embodiments of the invention have been described above, it will be recognized and understood that various modifications may be made therein and the appended claims are intended to cover all such modifications which may fall within the spirit and scope of the invention.

What is claimed is:

1. A padlock comprising:

a tubular shaped housing, having an open end for inserting and depositing a lock unit therein, two opposite holes near said open end, and two shackle holes for two feet of a shackle to fit in;

said lock unit comprising a sleeve, a pin base, and a base cap combined together, a bolt, a first spring urging said bolt, and a bolt holder, said sleeve having a key hole in an outer end surface, a slot extending rearward from an inner end to an intermediate portion, a pin hole and a groove in an opposite side from said slot, a second spring fitting around a peripheral surface of the intermediate portion of said sleeve, said pin base deposited in said sleeve and having a front rod portion and a rear disc portion, said disc portion having its outer end surface flush with said outer end surface of said sleeve and provided with a key hole, said base cap having a center hole fitting with said front rod portion of said pin base, and a slot extending from a front end to near a rear end, said pin base and said base cap secured with and in said sleeve by means of a pin inserting through said pin hole of said sleeve and a pin hole of said base cap, between said pin base and said base cap provided plural pins and plural springs respectively urging said pins rearward, said lock unit inserted through said open end of said housing and secured in said open end of said housing by means of a pin fitting in a hole of said housing and said groove of said sleeve, said bolt holder containing said bolt and said first spring urging said bolt and inserted through a hole of said housing and located in said slots of said sleeve and of said base cap, a lower end of said bolt engaging a sloped recess provided on said rod portion of said pin base;

a U-shaped shackle having one foot provided with a notch for an inner end wall of said sleeve to fit therein; and, said sleeve together with said pin base and said base cap being pushed from an unlocked position wherein said sleeve protrudes out a little from said housing, with said second spring being in a released condition, with said inner end wall of said sleeve being in disengaged condition from said notch of said shackle and said bolt having its lower end in contact with a peripheral surface of said rod portion of said pin base, said sleeve together with said pin base and said base cap pushed inward in said housing from said unlocked position to a locked position wherein said second spring is compressed, with said inner end wall of said sleeve fitting in said notch of said shackle, with said lower end of said bolt engaging said recess of said pin base, said pin base being rotated with a key for a certain preset angle for moving said lock unit from said locked position to said unlocked position.

2. The padlock as claimed in claim 1, wherein said rod portion of said pin base includes an extension and said shackle is further provided with another notch in the same foot which already has said notch for said inner end wall of said sleeve so that said rod portion may fit in said another notch in case said padlock is in the locked position.

3. The padlock as claimed in claim 1, wherein further a hook rod pulled by a spring is pivotally provided in an opposite end of said housing, and a push rod having one end pivotally connected with a lower end of said hook rod and the other end being in contact with said sleeve of said lock unit, said push rod pushing said hook rod to engage a notch in the other foot of said shackle so that said shackle is locked at its two feet by said sleeve of said lock unit and said hook rod if said two feet of said shackle are inserted in said housing and said lock unit is pushed in said housing to said locked position.

4. The padlock as claimed in claim 1, wherein the other foot of said shackle is provided with a notch in an inner side, and said housing has two opposite position holes near an intermediate portion and a shackle hole in the other closed end, and an auxiliary locking means is further provided in said housing, said auxiliary locking means comprising:

a front connect portion located in contact with an inner end of said sleeve of said lock unit, and having a shackle hole corresponding to said shackle hole of said housing for one foot of said shackle to fit therein;

an intermediate control portion located behind said front connect portion, having a cavity in a center section for a spring to lie longitudinally therein, a small position hole at an end of said cavity for inserting a pin therein, said pin passing through said housing from outside and through said position holes to keep said auxiliary locking means in place;

a rear hook portion located behind said control portion, having an outer end formed as an annular hook and able to engage the notch provided in the other foot of said shackle; and, said auxiliary locking means being moved by said lock unit to force said annular hook to engage said notch of the other foot of said shackle in addition to said lock unit engaging the original notch of the foot of said shackle in case said lock unit is pushed in said locked position.

* * * * *